US005368913A

United States Patent [19]

Ortega

[11] Patent Number: 5,368,913

[45] Date of Patent: Nov. 29, 1994

[54] ANTISTATIC SPUNBONDED NONWOVEN FABRICS

[75] Inventor: Albert E. Ortega, Pensacola, Fla.

[73] Assignee: Fiberweb North America, Inc., Simpsonville, S.C.

[21] Appl. No.: 133,892

[22] Filed: Oct. 12, 1993

[51] Int. Cl.[5] ..... B32B 27/14

[52] U.S. Cl. ..... 428/198; 156/290; 156/308.2; 428/288; 428/296; 428/297; 428/408; 428/902; 428/922

[58] Field of Search ..... 428/198, 285, 288, 296, 428/373, 408, 902, 458, 293, 294, 297, 922; 156/290, 308.2

[56] References Cited

U.S. PATENT DOCUMENTS

| | | | | |
|---|---|---|---|---|
| B1 | 4,565,727 | 1/1989 | Giglia et al. | 428/172 |
| | 2,845,962 | 8/1958 | Bulgin | 139/420 |
| | 3,586,597 | 6/1971 | Okuhashi | 161/87 |
| | 3,955,022 | 5/1976 | Sands | 428/95 |
| | 4,714,642 | 12/1987 | McAliley et al. | 428/113 |
| | 4,756,941 | 7/1988 | McCullough et al. | 428/95 |
| | 4,857,377 | 8/1989 | Daimon et al. | 428/90 |
| | 4,902,562 | 2/1990 | Bahia | 428/283 |
| | 4,999,240 | 3/1991 | Brotz | 428/288 |
| | 5,108,827 | 4/1992 | Gessner | 428/284 |
| | 5,124,075 | 6/1992 | Yasuda et al. | 428/220 |
| | 5,219,647 | 6/1993 | Vock et al. | 428/297 |

*Primary Examiner*—James J. Bell
*Attorney, Agent, or Firm*—Bell, Seltzer, Park & Gibson

[57] ABSTRACT

Antistatic spunbonded nonwoven fabrics are provided. The fabrics of the invention include a plurality of substantially continuous electrically nonconductive filaments formed of a thermoplastic polymer, a plurality of electrically conductive filaments distributed among the electrically nonconductive filaments throughout the fabric, and a multiplicity of discrete bond sites bonding together the electrically nonconductive and the electrically conductive filaments to form a coherent fabric.

20 Claims, 2 Drawing Sheets

ANTISTATIC SPUNBONDED NONWOVEN FABRICS

FIELD OF THE INVENTION

The present invention relates to nonwoven fabrics and to processes for producing the nonwoven fabrics. More specifically, the invention relates to nonwoven fabrics having antistatic properties, which are useful as a component in a product requiring antistatic characteristics, such as floor coverings, dryer sheets, upholstery, medical fabrics, and the like.

BACKGROUND OF THE INVENTION

Carpeting manufactured from staple fibers or continuous filaments may often become charged with static electricity upon being subjected to friction, especially when used at low humidity. This tendency is especially noticeable for hydrophobic fibers, such as polyamide, polyester, acrylic and polyolefin fibers. This can result in a variety of problems, such as the sound of the electrostatic discharge, clinging of garments, and electric shock, and interference with electronic apparatus, such as computers.

Prior techniques have addressed this problem by incorporating a small quantity of conductive fibers in the textile fiber material or the backing component of the fabric to act as a static dissipation element. For example, U.S. Pat. No. 4,756,941 to McCullough et al. discloses an electroconductive tow or yarn made from continuous filaments or staple fiber yarns. The yarns are prepared from stabilized petroleum pitch, coal tar pitch or a synthetic fiber forming material which on at least partial carbonization is electroconductive. The yarns are formed into coil-like fibers or filaments by winding the tow or yarn into a cloth, and heat treating the thus formed tow or yarn to a carbonizing temperature to set a coilure therein as well as electroconductive properties thereto. McCullough et al. describe the use of a blend of nylon and conductive fibers to form a web which is then needle punched onto a polypropylene spunbonded backing to give a conductive carpet.

U.S. Pat. No. 3,955,022 to Sands describes a primary carpet backing comprising a woven or bonded nonwoven sheet of continuous filaments having needled thereto a layer of a blend of staple fibers. The staple fibers include a synthetic organic polymeric fiber containing conductive carbon.

Despite these and other techniques for forming an antistatic fabric, it would be desirable to provide an antistatic fabric having a substantially uniform distribution of the conductive fibers throughout, so as to provide good static dissipation properties. This would in turn reduce the need for using antistatic chemicals or other additives in the fabric for static reduction. Further, it would be desirable to provide a fabric having conductive fibers which are firmly secured and held into place.

SUMMARY OF THE INVENTION

The present invention is directed to antistatic spunbonded nonwoven fabrics which provide good static dissipating properties. The fabrics are formed of a plurality of substantially continuous electrically nonconductive filaments formed of a thermoplastic polymer. To provide antistatic properties to the nonwoven fabric, a plurality of electrically conductive filaments are distributed among the electrically nonconductive filaments throughout the fabric. The electrically conductive filaments are selected from the group consisting of carbon filaments and metallic filaments, and preferably are multiconstituent filaments having a nonconductive nylon polymer component and a conductive carbon component.

In one embodiment of the invention, the antistatic fabric is a spunbonded fabric produced by extruding a plurality of continuous electrically nonconductive filaments of a thermoplastic polymer, directing the filaments with and through an attenuator device, such as a venturi nozzle, and then discharging the filaments from the attenuator and randomly depositing them on a collection surface. In this embodiment of the invention, the electrically conductive filaments are directed through the attenuator device used to form the spunbonded web of electrically nonconductive filaments and discharged onto the collection surface among the electrically nonconductive filaments.

In another embodiment of the invention, the fabric is also a spunbonded fabric produced as described above. In this embodiment, electrically conductive filaments are arranged in spaced apart relation from one another extending generally longitudinally to the fabric. The electrically conductive filaments are directed in generally spaced apart relation from one another onto the spunbonded fabric of electrically nonconductive filaments.

The electrically nonconductive filaments and the electrically conductive filaments are then bonded together via a multiplicity of discrete bond sites to form a coherent fabric. Bonding may be achieved thermally, for example, by forming discrete, spaced-apart thermal bonds, or chemically, by forming autogenous bonds at the filament cross-over points.

The resultant nonwoven fabric exhibits good antistatic properties, thus eliminating the need for additional antistatic agents. Further, the electrically conductive filaments are securely bonded to the electrically nonconductive filaments. The antistatic fabrics are particularly useful as components in products which require static dissipation, such as floor coverings, upholstery, dryer sheets, medical fabrics, and the like.

BRIEF DESCRIPTION OF THE DRAWINGS

In the drawings which form a portion of the original disclosure of the invention.

DETAILED DESCRIPTION OF THE INVENTION

In the following detailed description of preferred embodiments of the invention, specific terms are used in describing the invention; however these are used in a descriptive sense only and not for the purpose of limitation. It will be apparent that the invention is susceptible to numerous variations and modifications within its spirit and scope.

Figure 1:
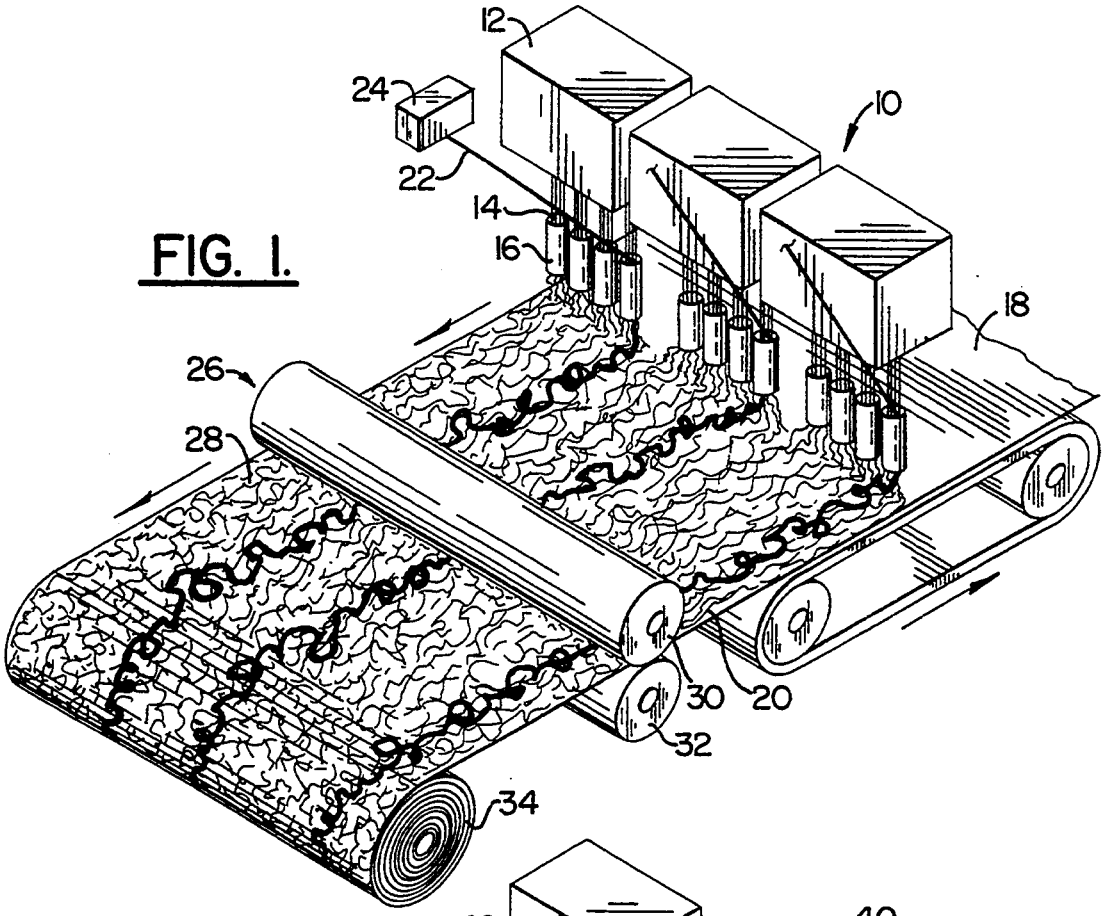
FIG. 1 is a perspective view of one method for producing an antistatic nonwoven fabric in accordance with the invention.

FIG. 1 illustrates a perspective view of one method for forming the antistatic nonwoven fabrics of the invention. In FIG. 1, a spunbonding apparatus, designated generally as 10, is provided. Various spunbonding techniques exist, but all typically include the basic steps of extruding continuous filaments, quenching the filaments, drawing or attenuating the filaments by a high velocity fluid, and collecting the filaments on a surface to form a web.

One difference in the various spunbonding processes is the attenuation device. For example, in the Lurgi spunbonding process, multiple round or tube-shaped venturi nozzles attenuate the filaments. A molten polymer is extruded from a spinneret as continuous filaments. The filaments are quenched, or solidified, by a flow of air and then enter the attenuator device where they are entrained with and drawn by large quantities of high pressure air. As the filaments and air exit the attenuator device, they form a cone or a fan of separated filaments which are deposited on a forming wire where they form a nonwoven filamentary web.

Various slot draw processes are also used to produce spunbonded nonwoven webs. In slot drawing, the multiple tube attenuators are replaced with a slot-shaped attenuator which extends widthwise of the machine. A supply of air is admitted into the slot attenuator below the spinneret face with or without a separate quench step. The air proceeds down the attenuator channel, which narrows in width in the direction away from the spinneret, creating a venturi effect, and causing filament attenuation. The filaments exit the attenuator channel and are collected on the forming wire. The attenuation air, depending on the type of slot draw process used, can be directed into the attenuation slot by a low pressure air supply above the slot, or by a vacuum located below the forming wire.

Any of the spunbonding techniques known in the art may be used in the present invention. Exemplary spunbonding techniques are described, for example, in U.S. Pat. Nos. 4,340,563 and 4,405,297 to Appel, et al. and U.S. Pat. No. 4,692,106 to Grabowski, et al.

In FIG. 1, the spunbonding apparatus 10 is illustrated as a Lurgi type spunbonding apparatus, although, as will be appreciated by the skilled artisan, other spunbonding apparatus may be used. Spunbonding apparatus 10 is provided with a plurality of generally linear die heads or spinnerets 12 for melt spinning streams of substantially continuous thermoplastic filaments 14. Any polymer or polymer blend which is capable of being melt spun to form electrically nonconductive filaments may be used in the present invention. Examples of polymers which may be suitably used in the present invention include polyester, acrylic, polyamide, polyolefin such as polyethylene, polypropylene, copolymers of the same, or the like, or other thermoplastic polymers, as well as copolymers and blends of these and other thermoplastic polymers. One particularly useful polymer is polyamide.

The spinnerets 12 preferably produce the streams of filaments in substantially equally spaced arrays. As the filaments exit the spinnerets, they are directed to attenuation devices 16 where the filaments are quenched and attenuated, either by the supply of attenuation air or by a separate supply of quench air. Attenuation devices 16 are illustrated in FIG. 1 as a plurality of tube-type apparati (Lurgi tubes), although the attenuator may be of any suitable type known in the art, such as a slot draw apparatus. Although a single quench and attenuation zone is shown in the drawing, it will be apparent to the skilled artisan that the filaments can exit the spinneret and be quenched by a separate supply of quench air before entering the attenuation device.

In the attenuation devices 16, the filaments become entrained in a high velocity stream of attenuation air and are thereby attenuated or drawn. The air and filaments are discharged from the lower end of the attenuation devices 16 and the filaments are collected on a forming wire 18 to form a nonwoven web 20.

In the method of the invention, a plurality of electrically conductive filaments are provided and directed among the electrically nonconductive filaments to thereby impart antistatic properties to the nonwoven fabric. In the embodiment of the method illustrated in FIG. 1, electrically conductive filaments 22 are provided via a plurality of supply rolls designated generally as 24. Alternatively, the electrically conductive filaments can be supplied from a spinning system, such as an extruder block and spinneret. In this embodiment of the invention, at least one electrically conductive filament is directed through at least one of the attenuator devices 16 and discharged from the attenuator device 16 onto the collection surface 18 among the electrically nonconductive filaments 14.

The amount of electrically conductive filaments provided can vary according to the desired degree of antistatic properties desired for the nonwoven fabric. Preferably, the electrically conductive filaments are considerably fewer in number than the electrically nonconductive filaments. For example, as illustrated in FIG. 1, at least one electrically conductive filament is provided for every fourth Lurgi-type attenuator device, although more or less filaments can be used, and more or less attenuator devices can be used.

The electrically conductive filaments are provided in an amount sufficient to impart the desired degree of conductivity or specific resistance to the nonwoven fabric. Preferably the electrically conductive filaments comprise about 8 percent to about 49 percent by weight of the antistatic nonwoven fabric of the invention. The amount of electrically conductive filaments can also be expressed as a percent of the total number of filaments. Again the percentage can vary according to the desired end fabric properties. For example, the electrically conductive filaments can be present in the fabric in an amount of about 1.3 to about 33 percent electrically conductive filaments of the total number of filaments in the nonwoven fabric.

As will be appreciated by the skilled artisan, in this embodiment of the invention, by providing electrically conductive filaments through an attenuator device, the electrically conductive filaments are entrained with the electrically nonconductive filaments. When the electrically conductive and the electrically nonconductive filaments are discharged from the attenuator device onto a forming screen, inherently the electrically conductive filaments are randomly and substantially distributed throughout the nonwoven fabric. Thus, the present invention provides a nonwoven fabric having good coverage of electrically conductive filaments throughout the fabric without requiring the use of a large number of such filaments. The entire nonwoven fabric exhibits good antistatic properties, thereby reducing the need for using antistatic chemicals or other additives in the fabric for static reduction. Further, because the electrically conductive filaments are entrained with the electrically nonconductive filaments, and subsequently bonded as described in more detail below, the electrically conductive filaments are firmly secured.

The electrically conductive filaments may be any of the electrically conductive filaments known in the art, such as carbon filaments, metallic filaments, and the like. As used herein the term "carbon filaments" refers to carbon fibers, such as fibers made by heating (or "carbonizing") precursor filaments, such as rayon or polyacrylonitrile fibers or petroleum residues, to appropriate temperatures to convert them to primarily carbon. The term carbon fibers also includes fibers made conductive by incorporating carbon into a polymeric fiber or filament structure, for example, by incorporating a core of carbon into a hollow polymer fiber or filament, by coating a fiber or filament with a sheath made of a composite containing carbon, by forming other bicomponent fiber or filament structures of a thermoplastic polymer and carbon, and the like. The term "metallic filaments" refers to fibers made conductive by incorporating a metal into a polymeric fiber or filament structure, and includes, for example, metal plated filaments, metal-deposited filaments, metallic strands, and the like.

In a preferred embodiment of the invention, the electrically conductive filaments used in accordance with the invention are multiconstituent filaments having a nonconductive polymer component and a conductive component, and more preferably a nonconductive nylon component and a conductive carbon component. Exemplary electrically conductive filaments include filaments available from Monsanto Chemical Company under the trade name No-Shock® Conductive Nylon; from Kanebo Ltd. under the trade name Belltron®; and the like.

After the spunbonded layer 20 is deposited onto screen 18, the web moves longitudinally as indicated by the arrows in FIG. 1 to a conventional bonding station 26. Here, a multiplicity of discrete bond sites are formed, bonding together the electrically nonconductive and the electrically conductive filaments to form a coherent bonded nonwoven fabric 28.

The bonding may be achieved by thermal bonding or chemical bonding, both of which are known to the skilled artisan. For example, as illustrated in FIG. 1, web 20 is directed to a conventional thermal treatment station 26. The thermal treatment station 26 is constructed in a conventional manner as known to the skilled artisan, illustrated in FIG. 1 as heated calender rolls 30 and 32. A chemical bonding station is illustrated and described in connection with the embodiment of FIG. 2 below.

The discrete bond sites are thermal bonds formed by heating the filaments so that they soften and become tacky, and fuse together contacting portions of the fibers. The operating temperature of heated rolls 30 and 32 should be adjusted to a surface temperature such that the nonconductive filaments present in nonwoven web 20 soften and bind the fibrous nonwoven web in discrete spaced apart areas to thereby form a nonwoven fabric 28. Because of the wide variety of polymers which can be used in the fabrics of the invention, bonding conditions, including the temperature and pressure of the bonding rolls, vary according to the particular polymer used, and are known in the art for differing polymers.

The pattern of the calender rolls may be any of those known in the art, including point bonding patterns, helical bonding patterns, and the like. The term point bonding is used herein to be inclusive of continuous or discontinuous pattern bonding, uniform or random point bonding, or a combination thereof, all as are well known in the art.

Although thermal bonding station 26 has been illustrated in FIG. 1, the heated calender rolls can, in other embodiments of the invention, be replaced by other thermal activation zones. For example, the thermal treatment station may be in the form of a through-air bonding oven or in the form of a microwave or other RF treatment zones. Other heating stations, such as ultrasonic welding stations can also be used in the invention. Such conventional heating stations are known to those skilled in the art and are capable of effecting thermal fusion of the nonwoven web via discrete thermal bonds distributed substantially throughout the nonwoven fabric 28.

The thermally bonded nonwoven fabric 28 is then removed from the nip of the heated rolls 30 and 32 and wound by conventional means onto roll 34. The nonwoven fabric 28 can be stored on roll 34 or immediately passed to end use manufacturing processes, for example for use as a backing component in a carpet.

Figure 2:
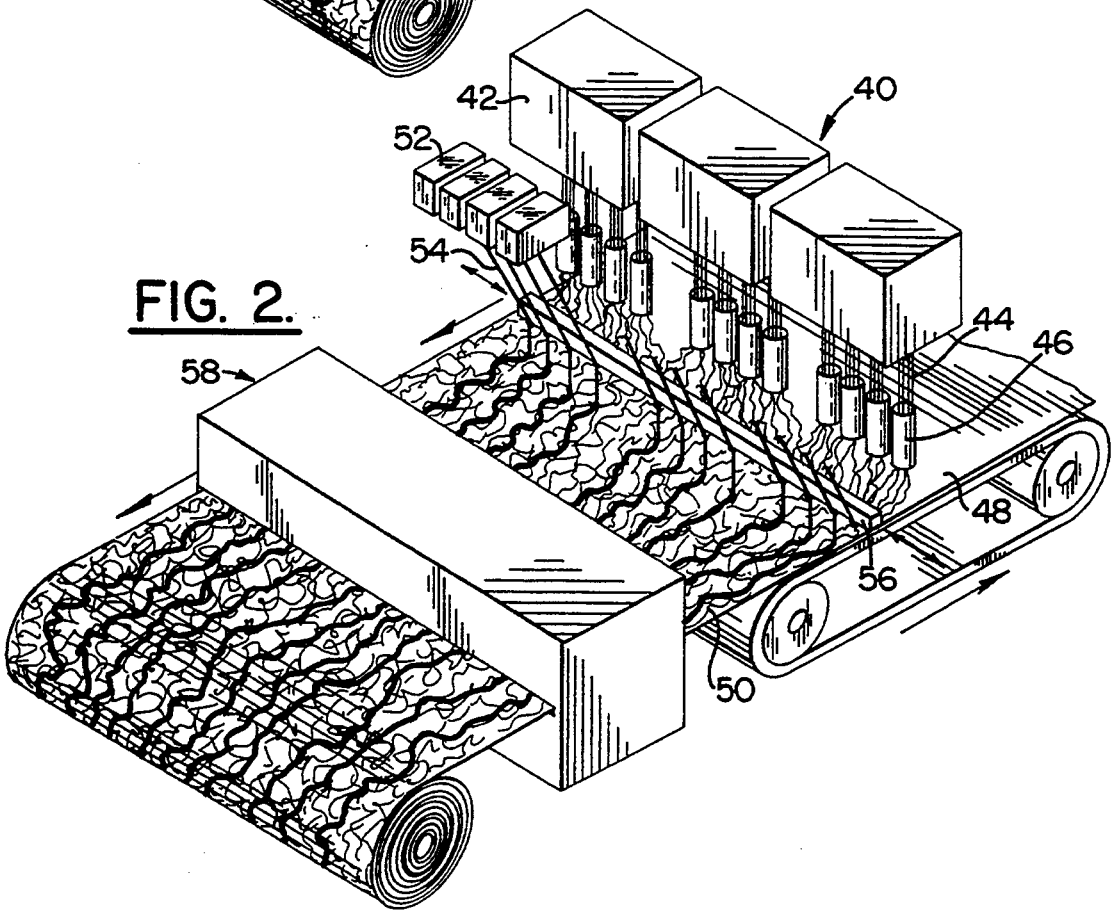
FIG. 2 is a perspective view of another method for producing an antistatic nonwoven fabric in accordance with the invention.

FIG. 2 illustrates another embodiment of the method of the present invention. In FIG. 2 a spunbonding apparatus similar to that described above is provided, designated generally as 40. As described above with regard to FIG. 1, in the embodiment illustrated in FIG. 2, a polymer is extruded from spinnerets 42 to form substantially continuous electrically nonconductive filaments 44. As the filaments exit the spinneret, they are directed to attenuation zones 46 where the filaments are quenched and attenuated. The filaments are discharged from the lower end of the attenuation zones 46 and the filaments are collected on a forming wire 48 to form a nonwoven web 50.

A supply of electrically conductive filaments is provided, illustrated in FIG. 2 as a plurality of supply rolls designated generally at 52. In this embodiment of the invention, a plurality of electrically conductive filaments, designated generally at 54, are directed in a generally spaced apart relation from one another onto the web 50 of electrically nonconductive filaments. For example, as illustrated in FIG. 2, the electrically conductive filaments 54 can be directed onto web 50 via a guiding rod 56. The rod 56 preferably is driven so that it oscillates back and forth in a direction perpendicular to the machine direction of the web, as indicated by the arrows. This movement allows distribution of the electrically conductive filaments in spaced apart relationship extending generally longitudinally on the spunbonded web 50.

As described above with regard to FIG. 1, in this embodiment of the invention, the electrically conductive filaments are present in an amount sufficient to impart the desired conductivity properties to the fabric, for example about 8.5 to about 49 percent by weight of the antistatic fabric. In contrast to the embodiment illustrated in FIG. 1, in this embodiment of the invention, the electrically conductive filaments are distributed throughout the fabric during the process of laying the electrically conductive filaments down onto the spunbonded fabric. As in the embodiment of FIG. 1, the electrically conductive filaments are considerably fewer in number than the electrically nonconductive filaments. Yet because the electrically conductive filaments are distributed throughout the fabric, the fabric still exhibits good antistatic properties using a small number of such filaments.

The spunbonded web 50 is then moved longitudinally as indicated by the arrows in FIG. 2 to bonding station 58. As described above, bonding station may be a thermal bonding station or a chemical bonding station. In FIG. 2, bonding station 58 is illustrated as a chemical bonding station, or a "gas house." The chemical bonding station is constructed in a conventional manner as known to the skilled artisan. In this embodiment of the invention, autogenous bonding is achieved by chemically activating the surface of the filaments until they reach an adhesive condition or by activating the surface of the filaments through heat application. Autogenous bonds are thus formed at the cross-over points of the filaments.

As will be understood by those skilled in the art, autogenous bonding refers to a process wherein filaments are contacted with a gas which will render the filaments cohesive and form bonds at their contacting points. For example, the surface of the filaments may be activated chemically by providing an acid gas (such as hydrochloric acid) and steam mixture, or activated thermally by providing steam heated to a temperature at which the surface of the filaments are activated to achieve bonding.

Figure 3:
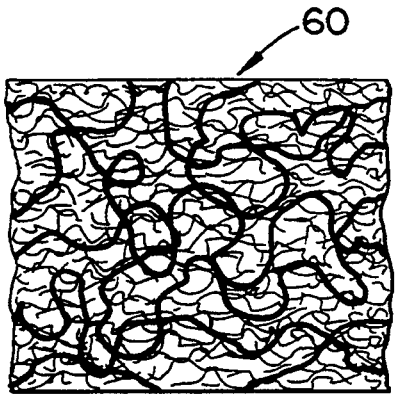
FIG. 3 is a fragmentary top plan view of a nonwoven fabric in accordance with the invention.
Figure 4:
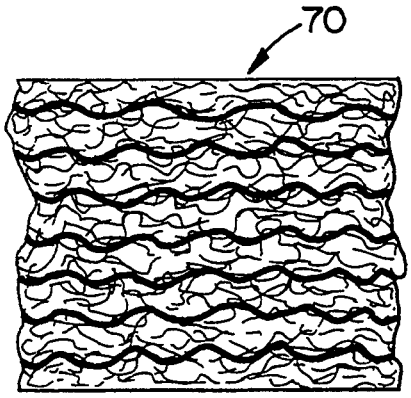
FIG. 4 is a fragmentary top plan view of another nonwoven fabric in accordance with the invention.

FIGS. 3 and 4 are fragmentary top plan views of nonwoven fabrics formed in accordance with the invention. Specifically, FIG. 3 is a top plan view of a fabric formed according to the process described in FIG. 1, and FIG. 4 is a top plan view of a fabric formed in accordance with the process described in FIG. 2.

Referring to FIG. 3, the web designated as 60 comprises substantially continuous nonconductive filaments formed of a thermoplastic polymer and a plurality of electrically conductive filaments randomly disposed throughout the fabric, prepared as described above. In FIG. 4, the web designated as 70 also comprises substantially continuous nonconductive filaments formed of a thermoplastic polymer and a plurality of electrically conductive filaments. In FIG. 4, in contrast to FIG. 3, the electrically conductive filaments are arranged in spaced apart relation from one another and extend in a generally longitudinal direction of the fabric. In both fabrics, the electrically conductive filaments are present in an amount less than the electrically nonconductive filaments. Advantageously, the electrically conductive filaments are present in an amount sufficient so that the spunbonded fabric has a specific resistance of less than about $2.44\times10^8$ ohms.

The fabrics of the invention preferably have a basis weight of from about 10 to 140 grams per square meter. The fabrics are advantageously used as a component in products in which antistatic properties are desirable, such as a component in carpeting, dryer sheets, upholstery, and the like. For example, the nonwoven fabrics of the invention may be used as the backing component of a carpet. Further, the fabrics of the invention can be used in medical fabric applications, such as surgical gowns, surgical drapes, sterile wraps, and the like. As will be apparent to the skilled artisan, the basis weight and the amount of electrically conductive filaments of the fabrics depend upon the desired end use of the fabric.

The following example serves to illustrate the invention but is not intended to be a limitation thereon.

EXAMPLE 1

Samples of an antistatic fabric in accordance with the present invention were prepared as described below. Nonwoven webs of chemically bonded spunbonded nonconductive nylon filaments were prepared. Such nylon spunbonded webs are known and sold under the trademark Cerex® by Fiberweb North America.

Antistatic yarn available from Monsanto Co. under the trade name No-Shock® Conductive Nylon was provided in an 18 denier threadline with four filaments yielding a 4.5 denier per filament yarn. One threadline per chimney was inserted into the spinning process. The conductive filaments were incorporated into the web by inserting one threadline into one of eight attenuating guns which carried the nonconductive filaments. All filaments were electrostatically charged by a corona assembly and dispersed onto a lay down belt.

The unbonded web was pressed and then directed to a chemical bonding station where the web was chemically bonded using hydrochloric gas at a temperature of about 31° C. As compared to conventional nylon Cerex® fabrics that do not include electrically conductive filaments, the fabrics formed in accordance with the present invention exhibited lower electrical resistivity properties.

The invention has been described in considerable detail with reference to its preferred embodiments. However, it will be apparent that numerous variations and modifications can be made without departure from the spirit and scope of the invention as described in the foregoing specification and defined in the appended claims.

That which is claimed is:

1. An antistatic spunbonded nonwoven fabric comprising a plurality of substantially continuous electrically nonconductive filaments formed of a thermoplastic polymer, a plurality of electrically conductive filaments distributed among said electrically nonconductive filaments throughout said fabric, and a multiplicity of discrete bond sites bonding together said electrically nonconductive and said electrically conductive filaments to form a coherent fabric.

2. The spunbonded nonwoven fabric according to claim 1 wherein said electrically conductive filaments are selected from the group consisting of carbon filaments and metallic filaments.

3. The spunbonded nonwoven fabric according to claim 1 wherein said electrically conductive filaments comprise multiconstituent filament having a nonconductive polymer component and a conductive component.

4. The spunbonded fabric according to claim 1 wherein said electrically conductive filaments comprise about 8 to about 49 percent by weight of said fabric.

5. The spunbonded nonwoven fabric according to claim 1 wherein said fabric has a specific resistance of less than about $2.44\times10^8$ ohms.

6. The spunbonded nonwoven fabric according to claim 1 wherein said discrete bond sites are defined by autogenous bonds at the filament cross-over points.

7. The spunbonded nonwoven fabric according to claim 1 wherein said discrete bond sites comprise discrete, spaced-apart thermal bonds.

8. The spunbonded nonwoven fabric according to claim 1 wherein said electrically nonconductive filaments are nylon filaments and said electrically conductive filaments comprise multiconstituent filaments having a nonconductive nylon component and a conductive carbon component.

9. The spunbonded nonwoven fabric according to claim 1 wherein electrically nonconductive filaments are randomly disposed throughout the fabric, and said electrically conductive filaments are considerably fewer in number than said electrically nonconductive filaments and are also randomly disposed throughout the fabric.

10. The spunbonded nonwoven fabric according to claim 1 wherein electrically nonconductive filaments are randomly disposed throughout the fabric, and said electrically conductive filaments are considerably fewer in number than said electrically nonconductive filaments and are arranged in spaced apart relation from one another extending generally longitudinally of the fabric.

11. An antistatic spunbonded nonwoven fabric comprising a plurality of substantially continuous electrically nonconductive nylon filaments randomly disposed throughout the fabric, a plurality of electrically conductive filaments fewer in number than said electrically nonconductive filaments and distributed among said electrically nonconductive filaments randomly throughout said fabric, said electrically conductive filaments comprising multiconstituent filaments having a nonconductive nylon component and a conductive carbon component, and a multiplicity of discrete bond sites bonding together said electrically nonconductive and said electrically conductive filaments to form a coherent fabric.

12. An antistatic spunbonded nonwoven fabric comprising a plurality of substantially continuous electrically nonconductive nylon filaments randomly disposed throughout the fabric, a plurality of electrically conductive filaments fewer in number than said electrically nonconductive filaments and arranged in spaced apart relation from one another extending generally longitudinally of the fabric, said electrically conductive filaments comprising multiconstituent filaments having a nonconductive nylon component and a conductive carbon component, and a multiplicity of discrete bond sites bonding together said electrically nonconductive and said electrically conductive filaments to form a coherent fabric.

13. A process for producing a spunbonded nonwoven fabric having antistatic properties comprising directing a plurality of substantially continuous electrically nonconductive filaments formed of a thermoplastic polymer onto a collection surface to form a web, also directing a plurality of electrically conductive filaments among said electrically nonconductive filaments, and forming a multiplicity of discrete bond sites in the fabric to bond together said electrically nonconductive and said electrically conductive filaments to form a coherent fabric.

14. The process according to claim 13 wherein the step of forming a multiplicity of discrete bond sites in the fabric comprises forming autogenous bonds at the filament cross-over points.

15. The process according to claim 14 wherein the electrically nonconductive filaments are nylon filaments and the step of forming autogenous bonds at the filament cross-over points comprises contacting the filaments with a gas which will render the filaments cohesive and form bonds at their cross-over points.

16. The process according to claim 13 wherein the step of forming a multiplicity of discrete bond sites in the fabric comprises heating the web of filaments in discrete, spaced-apart areas and forming thermal bonds.

17. The process according to claim 13 wherein the step of directing a plurality of substantially continuous electrically nonconductive filaments onto a collection surface includes directing the filaments through an attenuator device and thereafter discharging the filaments from the attenuator device onto the collection surface, and wherein the step of also directing a plurality of electrically conductive filaments among the electrically nonconductive filaments comprises also directing at least one electrically conductive filament through the attenuator device and discharging it onto the collection surface among the electrically nonconductive filaments.

18. The process according to claim 13 wherein the step of directing a plurality of substantially continuous electrically nonconductive filaments onto a collection surface includes directing the filaments through an attenuator device and thereafter discharging the filaments from the attenuator device onto the collection surface to form a web of filaments thereon, the step of forming a multiplicity of discrete bond sites in the fabric comprises directing the web of filaments through a heated calender and forming discrete thermal bonds, and the step of also directing a plurality of electrically conductive filaments among the electrically nonconductive filaments comprises directing the electrically conductive filaments in generally spaced apart relation from one another onto the web of electrically nonconductive filaments prior to directing the fabric through the heated calender.

19. A process for producing a spunbonded nonwoven fabric having antistatic properties comprising extruding an electrically nonconductive thermoplastic polymer in the form of a plurality of substantially continuous filaments, directing the electrically nonconductive filaments through an attenuator device to attenuate the filaments, discharging the attenuated filaments from the attenuator device onto a collection surface in a random arrangement to form a web of the electrically nonconductive filaments, also directing at least one electrically conductive filament through the attenuator device and discharging it onto the collection surface among the electrically nonconductive filaments and forming a multiplicity of discrete bond sites in the fabric to bond together said electrically nonconductive and said electrically conductive filaments to form a coherent fabric.

20. A process for producing a spunbonded nonwoven fabric having antistatic properties comprising extruding an electrically nonconductive thermoplastic polymer in the form of a plurality of substantially continuous filaments, directing the electrically nonconductive filaments through an attenuator device to attenuate the filaments, discharging the attenuated filaments from the attenuator device onto a collection surface in a random arrangement to form a web of the electrically nonconductive filaments, also directing a plurality of electrically conductive filament in generally spaced apart relation from one another onto the web of electrically nonconductive filaments and forming a multiplicity of discrete bond sites in the fabric to bond together said electrically nonconductive and said electrically conductive filaments to form a coherent fabric.

* * * * *